US011352747B2

(12) United States Patent
Ziegenbein

(10) Patent No.: US 11,352,747 B2
(45) Date of Patent: Jun. 7, 2022

(54) PROCESSES FOR IMPROVING HIGH ASPECT RATIO CELLULOSE FILAMENT BLENDS

(71) Applicant: Mercer International Inc., Vancouver (CA)

(72) Inventor: Tobias Ziegenbein, Vancouver (CA)

(73) Assignee: Mercer International Inc., Vancouver (CA)

( * ) Notice: Subject to any disclaimer, the term of this patent is extended or adjusted under 35 U.S.C. 154(b) by 537 days.

(21) Appl. No.: 16/383,459

(22) Filed: Apr. 12, 2019

(65) Prior Publication Data

US 2019/0316293 A1 Oct. 17, 2019

Related U.S. Application Data

(60) Provisional application No. 62/656,489, filed on Apr. 12, 2018.

(51) Int. Cl.

| | |
|---|---|
| ***D21C 5/00*** | (2006.01) |
| ***D21H 11/16*** | (2006.01) |
| ***D01F 2/00*** | (2006.01) |
| ***D01G 5/00*** | (2006.01) |

(52) U.S. Cl.

CPC ..... *D21C 5/00* (2013.01); *D01F 2/00* (2013.01); *D01G 5/00* (2013.01); *D21H 11/16* (2013.01); *D10B 2201/00* (2013.01)

(58) Field of Classification Search

None

See application file for complete search history.

(56) References Cited

U.S. PATENT DOCUMENTS

| | | | |
|---|---|---|---|
| 3,058,873 | A | 10/1962 | Keim |
| 3,301,746 | A | 1/1967 | Sanford et al. |
| 3,880,368 | A | 4/1975 | Matthew |
| 3,974,025 | A | 8/1976 | Ayers |

(Continued)

FOREIGN PATENT DOCUMENTS

| | | |
|---|---|---|
| WO | 2004057109 | 2/2004 |
| WO | 2007091942 | 8/2007 |

(Continued)

OTHER PUBLICATIONS

Nakano et al, Sequential washing with electrolyzed alkaline and acidic water effectively removes pathogens from metal surfaces, PLoS ONE 11(5): e0156058. doi:10.1371/journal.pone.0156058 (Year: 2015).*

(Continued)

*Primary Examiner* — Stefanie J Cohen

(74) *Attorney, Agent, or Firm* — Stephen T. Murphy Law LLC; Peter D. Meyer; Stephen T. Murphy

(57) ABSTRACT

A process for improving high aspect ratio cellulose filament blends comprising the steps of: a) providing a blend of cellulose nano-filaments or blend of cellulose micro-filaments; b) diluting the blend of cellulose nano-filaments or the blend of cellulose micro-filaments to a target consistency; c) fractionating the diluted blend of cellulose nano-filaments or the diluted blend of cellulose micro-filaments from the step c); and, d) collecting the fraction of the diluted blend of cellulose nano-filaments or the diluted blend of cellulose micro-filaments from the step c) having an average length of greater than at least about 25 μm.

18 Claims, 2 Drawing Sheets

(56) References Cited

U.S. PATENT DOCUMENTS 3,994,771 A 11/1976 Morgan, Jr. et al.
4,191,609 A 3/1980 Trokhan
4,300,981 A 11/1981 Carstens
4,374,702 A 2/1983 Turbak et al.
4,445,974 A 5/1984 Stenberg
4,447,294 A 5/1984 Osborn, III
4,529,480 A 7/1985 Trokhan
4,637,859 A 1/1987 Trokhan
4,735,849 A 4/1988 Murakami et al.
5,048,589 A 9/1991 Cook et al.
5,087,324 A 2/1992 Awofeso et al.
5,129,988 A 7/1992 Farrington, Jr.
5,399,412 A 3/1995 Sudall et al.
5,494,554 A 2/1996 Edwards et al.
5,582,685 A 12/1996 Vinson
5,607,551 A 3/1997 Farrington, Jr. et al.
5,629,055 A 5/1997 Revol et al.
5,656,132 A 8/1997 Farrington, Jr. et al.
5,759,926 A 6/1998 Pike et al.
5,840,403 A 11/1998 Trokhan et al.
5,895,710 A 4/1999 Sasse et al.
5,964,983 A 10/1999 Dinand et al.
6,017,417 A 1/2000 Wendt et al.
6,017,418 A 1/2000 Oriaran et al.
6,054,218 A 4/2000 Nucci et al.
6,183,596 B1 2/2001 Matsuda et al.
6,214,163 B1 4/2001 Matsuda et al.
6,231,657 B1 5/2001 Cantiani et al.
6,303,000 B1 10/2001 Floyd et al.
6,379,494 B1 4/2002 Jewell et al.
6,398,906 B1 6/2002 Kobayashi et al.
6,398,916 B1 6/2002 Klerelid
6,432,267 B1 8/2002 Watson
6,602,994 B1 8/2003 Cash et al.
6,992,728 B2 1/2006 Takagi et al.
7,314,665 B2 1/2008 Stelljes, Jr. et al.
7,381,294 B2 6/2008 Suzuki et al.
7,497,924 B2 3/2009 Nguyen et al.
7,566,014 B2 7/2009 Koslow et al.
7,718,036 B2 5/2010 Sumnicht et al.
7,744,726 B2 6/2010 Scherb et al.
7,811,418 B2 10/2010 Klerelid et al.
7,931,781 B2 4/2011 Scherb et al.
7,988,829 B2 8/2011 Klerelid et al.
8,066,849 B2 11/2011 Kokko et al.
8,236,140 B2 8/2012 Scherb et al.
8,268,130 B2 9/2012 Sinkko et al.
8,298,374 B2 10/2012 Shannon et al.
8,377,563 B2 2/2013 Miyawaki et al.
8,388,803 B2 3/2013 Super et al.
8,444,808 B2 5/2013 Koslow et al.
8,608,906 B2 12/2013 Laleg et al.
8,608,909 B2 12/2013 Scherb et al.
8,658,287 B2 2/2014 Berglund et al.
8,778,505 B2 7/2014 Shannon
8,821,690 B2 9/2014 Oksanen et al.
8,834,677 B2 9/2014 Tirimacco et al.
8,846,993 B2 * 9/2014 Powell ..... B01D 29/56 585/240
8,871,922 B2 10/2014 Hu et al.
8,906,198 B2 12/2014 Sabourin et al.
8,992,728 B2 3/2015 Isogai et al.
9,017,517 B2 4/2015 Super et al.
9,051,684 B2 6/2015 Hua et al.
9,187,865 B2 11/2015 Nelson et al.
9,206,551 B2 12/2015 Esser
9,340,914 B2 5/2016 Manifold et al.
9,375,116 B2 6/2016 Graff
9,422,641 B2 8/2016 Jakson et al.
9,441,326 B2 9/2016 Kawka
9,493,911 B2 11/2016 Miller et al.
9,506,198 B2 11/2016 Laine et al.
9,663,901 B2 5/2017 Heiskanen et al.
9,702,085 B2 7/2017 Kosonen et al.
9,739,015 B2 8/2017 Miller et al.
9,777,129 B2 10/2017 Sumnicht et al.
9,856,607 B2 1/2018 Hua et al.
9,879,361 B2 1/2018 Pande et al.
9,988,762 B2 6/2018 Bilodeau et al.
2002/0148581 A1 * 10/2002 De Rigaud ..... D21H 11/14 162/147
2002/0168912 A1 11/2002 Bond et al.
2003/0203695 A1 10/2003 Polanco et al.
2004/0118540 A1 6/2004 Garnier et al.
2005/0153100 A1 7/2005 Zoller et al.
2007/0207293 A1 9/2007 Santiago
2008/0057307 A1 3/2008 Koslow et al.
2009/0020248 A1 1/2009 Sumnicht et al.
2009/0054858 A1 2/2009 Cheng et al.
2009/0221812 A1 9/2009 Ankerfors et al.
2009/0264036 A1 10/2009 Yano et al.
2010/0065236 A1 3/2010 Henriksson et al.
2010/0147473 A1 6/2010 Ward et al.
2010/0186922 A1 7/2010 Quigley
2011/0265965 A1 11/2011 Sumnicht et al.
2011/0277947 A1 * 11/2011 Hua ..... D21H 21/10 162/28
2012/0012031 A1 1/2012 Husband et al.
2012/0094953 A1 4/2012 Gane et al.
2012/0097616 A1 * 4/2012 Backman ..... B03D 1/02 210/703
2012/0132383 A1 5/2012 Laine et al.
2012/0136146 A1 5/2012 Heiskanen et al.
2012/0277351 A1 11/2012 Yano et al.
2012/0285640 A1 11/2012 Westland et al.
2013/0017394 A1 1/2013 Hua et al.
2013/0319625 A1 12/2013 Mohammadi et al.
2014/0124152 A1 5/2014 Polat et al.
2015/0041091 A1 2/2015 Castro et al.
2015/0057442 A1 2/2015 Bjorkqvist et al.
2015/0125658 A1 5/2015 Bilodeau et al.
2015/0275433 A1 10/2015 Dorris et al.
2015/0368368 A1 12/2015 Retsina et al.
2016/0040354 A1 * 2/2016 Hallett ..... D21C 3/06 435/99
2016/0090692 A1 3/2016 Eagles et al.
2016/0138224 A1 5/2016 Shannon et al.
2016/0160448 A1 6/2016 Miller, IV et al.
2016/0215179 A1 7/2016 Sumnicht et al.
2016/0289453 A1 10/2016 Cai et al.
2016/0319482 A1 11/2016 Ben et al.
2016/0362843 A1 12/2016 Hermans et al.
2017/0167079 A1 6/2017 Hepworth et al.
2017/0175332 A1 6/2017 Monhammadi et al.

FOREIGN PATENT DOCUMENTS

WO 2011154855 5/2011
WO 2011064441 6/2011
WO 2012097446 7/2012
WO 2013160553 10/2013
WO 2014029917 2/2014
WO 2015044520 4/2015
WO 2016176759 11/2016
WO 2017008171 1/2017

OTHER PUBLICATIONS

Ulrich Hirn & Robert Schennach, Comprehensive analysis of individidual Pulp fiber bonds quantifies the mechanisms of fiber bonding in paper, Nature Magazine/Scientific Reports, May 22, 2015.
Jack Miller, Nanocellulosestate of the Industry, Dec. 2015.
Rauni Seppanen, Use of nanocellulose for high performance papermaking products, Sep. 30, 2014.
Robert J. Moon, Ashlie Martini, John Nairn, John Simonsen, Jeffrey Youngblood, Cellulose nanomaterials review: structure, properties and nanocomposites, Chem. Soc. Rev., 2011,40, 3941-3994.
E.C. Homonoff, R.E. Evans, C.D. Weaver, Nanofibrillated Cellulose Fibers: Where Size Matters in Opening New Markets to Nanofiber Usage, Presentation to 2008 TAPPI Nanotechnology Conference, Jun. 25-27, 2008.

(56) References Cited

OTHER PUBLICATIONS

Mark Williamson, Canadian mills test drive cellulose filaments, Paper Advance, Jun. 8, 2015.
Suzanne Pinkney, David Skuse, Neil Rowson, Stuart Blackburn, Microfibrillated cellulose—a new structural material.
Tero Taipale, Interactions of Microfibrillated Cellulose and Cellulosic Fines with Cationic Polyelectrolytes, Doctoral Dissertation, TKK Reports in Forest Products Technology, Series A12, Oct. 22, 2010.
Mikael Ankerfors, Microfibrillated cellulose: Energy-efficient preparation techniques and applications in paper, Doctoral Thesis, KTH Royal Institute of Technology, Stockholm, Sweden, 2015.
Hernan Charreau, Maria L. Foresti, and Analia Vazquez, Nanocellulose Patents Trends: A Comprehensive Review on Patents on Cellulose Nanocrystals, Microfibrillated and Bacterial Cellulose, Recent Patents on Nanotechnology, 2012, 7, 56-80.
Gary Chinga-Carrasco, Cellulose fibres, nanofibrils and microfibrils: The morphological sequence of MFC components from a plant physiology and fibre technology point of view, Nanoscale Research Letters 20116:417, Jun. 13, 2011.
Solenis International LP, Hercobond (TM) 1194 dry strength resin, Product Data solenis.com, DSR-PDS-NA-Hercobond 1194-R2.
Valmet, Valmet's Advantage (TM) NTT (R) Concept, Valmet Technical Paper Series, Dec. 3, 2009.
Balazs Tolnai, FiloCell (TM)—Commercialization of Cellulose Filament, PACWEST Conference, Jun. 11, 2015.
Xujun Hua, Makhlouf Laleg and Thomas Owston, Cellulose Filaments: Discovery by FPInnovations of a Novel Strengthening Agent, PACWEST Conference, Jun. 11, 2015.
Israel Gonzalez, Sami Boufi, Maria Angels Pelach, Manelalcala Fabiola Vilaseca, and Pere Mutje, Nanofibrillated Cellulose as Paper Additive in Eucalyptus Pulp, BioResources.com, 5167-5180, 2012.
Susanna Ahola, Monika Osterberg, Janne Laine, Cellulose nanofibrils-adsorption with poly(amideamine) epichlorohydrin studies by QCM-D and application as a paper strength additive, Cellulose (2008) 15:303-314.
Tsuguyuki Saito, Satoshi Kimura, Yoshiharu Nishiyama, Akira Isogai, Cellulose Nanofibers Prepared by TEMPO-Mediated Oxidation of Native Cellulose, Biomacromolecules (2007) 8, 2485-2491.
Hans-Peter Hentze, Nanocellulose Science Toward Application, Pulp Paper Jun. 2, 2010, 2019 (Abstract).
Ulla Forsstrom, From Nanocellulose Science towards Application, Status from Finland, 2012 (Presentation).
Yucheng Peng, Douglas J. Gardner, Yousoo Han, Drying Cellulose NanofibrilsL in search of a Suitable Method, Cellulose COI 10.1007/s 10570-011-9630-z 2011.
Zhe Yuan, Jinsong Zeng, Kefu Chen, Dynamic Characterization of Cellulose Nanofibrils, ICMSE 397 (2018) 012002.

* cited by examiner

- Hans-Peter Hentze, VTT - 'From Nanocellulose Science towards Applications' - 2nd of June 2010 -

PROCESSES FOR IMPROVING HIGH ASPECT RATIO CELLULOSE FILAMENT BLENDS

FIELD OF THE INVENTION

The present application relates to improved high aspect ratio cellulose filaments and blends thereof. The present disclosure also relates to improved processes for producing high aspect ratio cellulose filaments and blends thereof. This application also relates to processes for improving the performance of high aspect ratio cellulose filaments made from natural fibers originated from wood and other plant pulps. This application also relates to improved paper products comprising the improved filament blends and improved paper products comprising cellulose nano-filament blends produced by the improved processes for producing high aspect ratio cellulose nano-filaments and blends thereof. The paper products include, but are not limited to, fine papers, printing papers, packaging paper, specialty papers, facial tissues, paper towels, bath tissues, napkins, air-laid papers, concrete materials and other similar products.

BACKGROUND OF THE INVENTION

The development and refinement of high aspect ratio cellulose particles for the use in papermaking and more specifically fine papermaking, paper grades for packaging and tissue towel and sanitary tissue papermaking including both conventional dry crepe and structured papermaking, has been a focus for decades. However, developmental options proposed to date have had many limitations, therefore the broad application of high aspect ratio particles into papermaking has not developed.

Turbak, et al. (U.S. Pat. No. 4,374,702) disclosed a finely divided cellulose, called micro-fibrillated cellulose (MFC), and a method to produce it. The micro-fibrillated cellulose is composed of shortened fibers attached with many fine fibrils. During micro-fibrillation the lateral bonds between fibrils in a fiber wall is disrupted to result in partial detachment of the fibrils, or fiber branching as defined in U.S. Pat. Nos. 6,183,596, 6,214,163 and 7,381,294. Turbak further discloses a process of producing the micro-fibrillated cellulose by forcing cellulosic pulp repeatedly through small orifices of a homogenizer. This orifice generates high shear action and converts the pulp fibers to micro-fibrillated cellulose. The high fibrillation increases chemical accessibility and results in a high water retention value, which allows achieving a gel point at a low consistency. It was shown that MFC improved paper strength when used at a high dosage. For example, the burst strength of handsheets made from unbeaten Kraft pulp was improved by 77% when the sheet contained about 20% micro-fibrillated cellulose. Length and aspect ratio of the micro-fibrillated fibers are not defined in the patent, but the fibers were pre-cut before going through the homogenizer. Japanese patents JP 58197400 and JP 62033360 also disclose that micro-fibrillated cellulose produced in a homogenizer improves paper tensile strength.

Matsuda, et al. (U.S. Pat. Nos. 6,183,596 and 6,214,163) disclosed a super-micro-fibrillated cellulose which was produced by adding a grinding stage before a high-pressure homogenizer. Similar to the previous disclosures, micro-fibrillation in Matsuda's process proceeds by branching fibers while the fiber shape is kept to form the micro-fibrillated cellulose. However, the super micro-fibrillated cellulose has a shorter fiber length (50-100 μm) and a higher water retention value compared to those disclosed previously. The aspect ratio of the super MFC is between 50-300. The super MFC was suggested for use in the production of coated papers and tinted papers.

Micro-fibrilated cellulose can also be produced by passing pulp ten times through a grinder without further homogenization as disclosed in Tangigichi and Okamura, Fourth European Workshop on Lignocellulosics and Pulp, Italy, 1996. A strong film formed from the MFC was also reported by Tangigichi and Okamura, Polymer International 47(3): 291-294 (1998). Subramanian, et al. [JPPS 34(3) 146-152 (2008)] disclosed the use MFC made from a grinder as a principal furnish component to produce sheets containing over 50% filler.

Suzuki, et al. (U.S. Pat. No. 7,381,294 and International Patent Application Publication 2004/009902) disclosed a method to produce micro-fibrillated cellulose fiber which is also defined as branched cellulose fiber. The method therein consists of treating pulp in a refiner at least ten times, but preferably 30 to 90 times. The inventors claim that this is the first process which allows for continual production of MFC. The resulting MFC has a length shorter than 200 μm, a very high water retention value, over 10 mL/g, which causes it to form a gel at a consistency of about 4%. The preferred starting material of Suzuki's disclosure is short fibers of hardwood Kraft pulp.

Cash, et al. (U.S. Pat. No. 6,602,994) disclosed a method to make derivatized MFC, for example, micro-fibrillated carboxymethyl cellulose (CMC). The micro-fibrillated CMC improves paper strength in a way similar to the ordinary CMC.

Charkraborty, et al. reported that a novel method to generate cellulose micro-fibrils which involves refining with PFI mill followed by cryocrushing in liquid nitrogen. The fibrils generated in this way had a diameter about 0.1-1.0 μm and an aspect ratio between 15-85 [Holzforschung 59(1): 102-107 (2005)].

To reduce energy and avoid clogging in the production of MFC with fluidizers or homogenizers, Lindstrom et al. proposed a pretreatment of wood pulp with refining and enzyme prior to a homogenization process (International Patent Application Publication WO2007/091942, 6th International Paper and Coating Chemistry Symposium). The resulting MFC is smaller, with widths of 2-30 nm, and lengths from 100 nm to 1 μm. To distinguish it from the earlier MFC, the authors named it nano-cellulose [Ankerfors and Lindstrom, 2007 PTS Pulp Technology Symposium], or nano-fibrils [Ahola et al., Cellulose 15(2): 303-314 (2008)]. The nano-cellulose or nano-fibrils had a very high water retention value and behaved like a gel in water. To improve bonding capacity, the pulp was carboxy methylated before homogenization.

Nano-fibers with a width of 3-4 nm were reported by Isogai, et al [Biomacromolecules 8(8): 24852491 (2007)]. The nano-fibers were generated by oxidizing bleached Kraft pulps with 2,2,6,6tetramethylpiperidine-1-oxyl radical (TEMPO) prior to homogenization. The film formed from the nano-fibers is transparent and has also high tensile strength [Biomacromolecules 10(1): 162165 (2009)]. The nano-fibers can be used for reinforcement of composite materials (US Patent Application 2009/0264036 A1).

Even smaller cellulosic particles having unique optical properties, are disclosed by Revol, et al. (U.S. Pat. No. 5,629,055). These micro-crystalline celluloses (MCC), or nano-crystalline celluloses as renamed recently, are generated by acid hydrolysis of cellulosic pulp and have a size about 5 nm by 100 nm. There are other methods to produce MCC, for example, one disclosed by Nguyen, et al in U.S. Pat. No. 7,497,924, which generate MCC containing higher levels of hemicellulose.

The above mentioned products, nano-cellulose, micro-fibrils or nano-fibrils, nano-fibers, and micro-crystalline cellulose or nano-crystalline cellulose, are relatively short particles. They are normally much shorter than 1 micrometer, although some may have a length up to a few micrometers. There are no data to indicate that these materials can be used alone as a strengthening agent to replace conventional strength agents for papermaking. In addition, with the current methods for producing micro-fibrils or nano-fibrils, the pulp fibers have to be cut inevitably. As indicated by Cantiani, et al. (U.S. Pat. No. 6,231,657), in the homogenization process, micro- or nano-fibrils cannot simply be unraveled from wood fibers without being cut. Thus, their length and aspect ratio are limited.

More recently, Koslow and Suthar (U.S. Pat. No. 7,566,014) disclosed a method to produce fibrillated fibers using open channel refining on low consistency pulps (i.e. 3.5% solids, by weight). They disclose open channel refining that preserves fiber length, while close channel refining, such as a disk refiner, shortens the fibers. In their subsequent patent application (U.S. Patent Application Publication 2008/0057307), the same inventors further disclosed a method to produce nano-fibrils with a diameter of 50-500 nm. The method consists of two steps: first using open channel refining to generate fibrillated fibers without shortening, followed by closed channel refining to liberate the individual fibrils. The claimed length of the liberated fibrils is said to be the same as the starting fibers (0.1-6 mm). We believe this is unlikely because closed channel refining inevitably shortens fibers and fibrils as indicated by the same inventors and by other disclosures (U.S. Pat. Nos. 6,231,657 and 7,381,294). The inventors' close refining refers to commercial beater, disk refiner, and homogenizers. These devices have been used to generate micro-fibrillated cellulose and nano-cellulose in other prior art mentioned earlier. None of these methods generate the detached nano-fibril with such high length (over 100 micrometers). Koslow, et al. acknowledge in U.S. Patent Application Publication 2008/0057307 that a closed channel refining leads to both fibrillation and reduction of fiber length and generate a significant amount of fines (short fibers). Thus, the aspect ratio of these nano-fibrils should be similar to those in the prior art and hence relatively low.

Furthermore, the method of Koslow, et al. is that the fibrillated fibers entering the second stage have a freeness of 50-0 ml CSF, while the resulting nano-fibers still have a freeness of zero after the closed channel refining or homogenizing. A zero freeness indicates that the nano-fibrils are much larger than the screen size of the freeness tester, and cannot pass through the screen holes, thus quickly forms a fibrous mat on the screen which prevents water to pass through the screen (the quantity of water passed is proportional to the freeness value).

The closed channel refining has also been used to produce MFC-like cellulose material, called as micro-denominated cellulose, or MDC (Weibel and Paul, UK Patent Application GB 2296726). The refining is done by multiple passages of cellulose fibers through a disk refiner running at a low to medium consistency, typically 10-40 passages. The resulting MDC has a very high freeness value (730-810 ml CSF) even though it is highly fibrillated because the size of MDC is small enough to pass through the screen of freeness tester. Like other MFC, the MDC has a very high surface area, and high water retention value. Another distinct characteristic of the MDC is its high settled volume, over 50% at 1% consistency after 24 hours settlement.

Hua, et al (U.S. Pat. No. 9,051,684 B2, U.S. Patent Application Publication 2013/0017394 and U.S. Patent Application Publication 2015/0275433A1) disclosed a method to produce cellulose nano-filaments (CNF), defined and referred to as cellulose filaments (CF), have lengths of up to 300-350 um and diameters of approximately 100-500 nm. The CFs are produced by multi-pass, high consistency refining of wood or plant fibers such as a bleached softwood Kraft pulp as described in International Patent Application Publication WO2012/097446 A1 incorporated herein by reference. The CFs are structurally very different from other cellulose fibrils such as micro-fibrillated cellulose (MFC) or nano-fibrillated cellulose (NFC) prepared using other methods for the mechanical disintegration of wood pulp fibers in that they have at least 50%, preferably 75%, and more preferably 90% by weight of the filaments of the fibrillated cellulose material have a filament length of up to 300-350 μm and diameters of approximately 100-500 nm.

More recently Bilodeau, et al (U.S. patent Ser. No. 15/309,117) disclosed a method to produce nano-fibers from cellulosic material by first treating the material with a mechanical refiner of a specific and unique design and then treating the material with a second refiner having a second specific refining edge load, where the first refining edge load is 2-40 times higher than the second edge load. The cellulose nano-fibers created have a fiber length of about 0.2 mm to about 0.5 mm.

Even more recently Bjorkquist, et al. U.S. Patent Application Publication 2015/0057442 A1 discloses a process for the manufacture of fibril cellulose by mechanically refining with decreasing refiner plate gap lower than 3 um and a specified surface roughness and thereby separating fibrils by means of interaction with the surface roughness. Bjorkquist discloses that with s specific energy of refining of 2.00 to 3.00 kWh per Kg of pulp, a fibril cellulose product is obtained of target viscosity.

While there are many means for the production of high aspect ratio cellulose filaments of various sizes and shapes, in general, these materials have the disadvantage to papermakers of a high freeness drop which results in drying difficulty and increased papermaking costs along with issues in generating sufficient product improvements to justify the added costs to incorporate these materials.

SUMMARY OF THE INVENTION

The present disclosure provides processes for improving high aspect ratio cellulose filament blends. The process comprises the steps of: providing a currently available blend of cellulose nano-filaments or blend of cellulose micro-filaments; diluting the currently available blend of cellulose nano-filaments or blend of cellulose micro-filaments to a target consistency; fractionating the diluted currently available blend of currently available cellulose nano-filaments or diluted blend of cellulose micro-filaments, wherein the fractionation discriminates by size or density; and, collecting and removing the fraction of the diluted blend of cellulose nano-filaments or the diluted blend of cellulose micro-filaments having an average length of greater than at least about 25 μm producing an improved blend of cellulose nano-filaments or improved blend of micro-filaments. In an alternative embodiment the collecting and removing step, removes the fraction of the diluted blend of cellulose nano-filament or the diluted blend of cellulose micro-filaments having an aspect ratio of greater than about 50.

The present application also relates to processes for improving high aspect ratio cellulose filament blends comprising the steps of providing a blend of cellulose nanofilaments or a blend of cellulosic microfilaments; and washing at specific pH targets and fractionating the provided blend of high aspect ratio cellulose filaments.

The present processes produces improved high aspect ratio cellulosic filament blends over the currently available blends, where the improvement is that the new blends have a particle size distribution where a portion of the very small particles of the original delivered blend distribution, those with an average filament width of less than about 20 μm and an aspect ratio of less than about 50, have been removed. These improved products also demonstrate that they have an average filament width of greater than about 20 microns and the blend comprising a reduced level of particles passing a 325 mesh fabric of a Bauer McNett classifier than the originally provided blend of cellulose nano-filaments.

The present application also relates to improved paper products such as fine paper for printing and writing, paperboard and paperboard products, and packaging grades, airlaid tissue, tissue and towel products and sanitary tissue products. The improved high aspect ratio cellulose filament blends are also valuable in for example but not limited to plastic composite products, coating films, and concrete products.

DETAILED DESCRIPTION OF THE INVENTION

Figure 1:
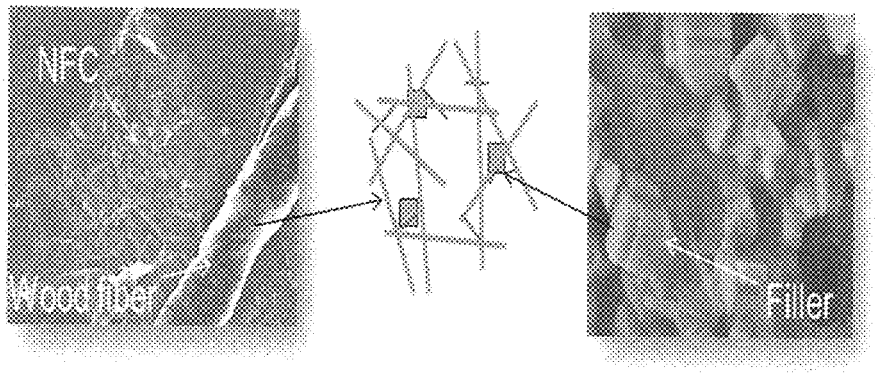
FIG. 1 is a photomicrograph showing the bonding of small particles in cellulosic sheet products.

"Aspect Ratio", as used herein, describes the proportional relationship between the length of an object, herein a filament and its width (or diameter).

"Consistency" as used herein, describes the dry solid content of pulp slurry in water. When papermakers use the word "consistency" they usually mean the same thing as "solids" or "percent solids." Consistency can be measured by collecting the slurry solids on a tared filter paper, drying the paper at 105 degrees Centigrade, and dividing the mass of the solids by the mass of the original slurry. Consistency also can be estimated by light scattering and depolarization measurements at one or more wavelengths. It can be recommended that such optical data be frequently recalibrated with representative samples of furnish or white water from the system of interest.

"Fiber", as used herein, means an elongate physical structure having an apparent length greatly exceeding it apparent diameter, i.e. a length to diameter ratio of at least about 10 and less than 200. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present disclosure contemplates the use of a variety of fibrous structure-making fibers, such as, for example, natural fibers, such as cellulose nano-filaments and/or wood pulp fibers, non-wood fibers or any suitable fibers and any combination thereof.

Natural fibrous structure-making fibers useful in the present disclosure include animal fibers, mineral fibers, plant fibers, man-made spun fibers, and engineered fibrous elements such as cellulose nano-filaments. Animal fibers may, for example be selected from the group consisting of wool, silk, and mixtures thereof. The plant fibers may, for example, be derived from a plant selected from the group consisting of wood, cotton, cotton linters, flax, sisal, abaca, hemp, hesperaloe, jute, bamboo, bagasse, esparto grass, straw, jute, hemp, milkweed floss, kudzu, corn, sorghum, gourd, agave, trichomes, loofah and mixtures thereof.

Wood fibers; often referred to as wood pulps are liberated from their source by any one of a number of chemical pulping processes familiar to one experienced in the art, including Kraft (sulfate), sulfite, polysulfide, soda pulping, etc. Further, the fibers can be liberated from their source using mechanical and semi-chemical processes including, for example, roundwood, thermomechanical pulp, chemomechanical pulp (CMP), chemi-thermomechanical pulp (CTMP), alkaline peroxide mechanical pulp (APMP), neutral semi-chemical sulfite pulp (NSCS), are also contemplated. The pulp can be whitened, if desired, by any one or combination of processes familiar to one experienced in the art including the use of chlorine dioxide, oxygen, alkaline peroxide, and so forth. Chemical pulps may be preferred since they impart superior tactile feel and/or desired paper sheet properties. Pulps derived from both deciduous trees (hereinafter, referred to "hardwood") and coniferous trees (hereinafter, also referred to as "softwood") may be utilized and/or fibers derived from non-woody plants along with man-made fibers. The hardwood, softwood, and/or non-wood fibers can be blended, or alternatively, can be deposited in layers to provide a stratified and/or layered web. Also applicable to the present disclosure are fibers derived from recycled paper, as well as other non-fibrous materials, such as adhesives used to facilitate the original papermaking and paper converting. The wood pulp fibers may be short (typical of hardwood fibers or many non-wood fibers) or long (typical of softwood fibers and some non-wood fibers).

Examples of softwood fibers that can be used in the paper webs of the present disclosure include but are not limited to fibers derived from pine, spruce, fir, tamarack, hemlock, cypress, and cedar. Softwood fibers derived from the Kraft process and originating from more-northern climates may be preferred. These are often referred to as northern bleached softwood Kraft (NBSK) pulps.

As used herein, "filaments" (e.g., cellulose nano-filaments and/or cellulose micro-filaments) may be derived from either softwood and/or hardwood and nonwoody materials and as such may contain fibrous elements of these base materials. Currently available cellulose nano-filament blend and/or cellulose micro-filament blends can have an average width in the nanometer/micrometer range respectively, for example an average width of about 20 um to about 500 nm, and an average length in the micrometer range or above, for example an average length above about 10 μm. Such cellulose nano-filaments and/or cellulose micro-filaments can be obtained, for example, from processes which uses mechanical means only. In addition, cellulose nano-filaments and/or cellulose micro-filaments can be made from a variety of processes as long as the specified geometry is maintained. Processes currently used to create cellulose nano-filaments and/or cellulose micro-filaments include but are not limited to modified refining equipment, homogenizers, sonic fiber treatment, and chemical fiber treatment including enzymatic fiber modification. Micro-fibrillated cellulose (MFC) and cellulose nano-filaments (CNF) should and can be considered as general terms.

The currently available cellulosic filament blends can refer to blends of cellulose nanofibrils or microfibrils or nanofibril bundles or microfibril bundles separated from cellulose based fiber raw material. These fibrils are characterized by a high aspect ratio (length/diameter): their length may exceed 1 μm, whereas the diameter typically remains smaller than 200 nm. The smallest fibrils are in the size class of so-called elementary fibrils, where the diameter is typically 2 to 12 nm. The dimensions and size distribution of the fibrils depend on the refining method and efficiency. Fibril cellulose can be characterized as a cellulose based material, in which the median width of particles (fibrils or fibril bundles) is not greater than 10 μm, for example between 0.2 and 10 μm, advantageously not greater than 1 μm, and the particle diameter is smaller than 1 μm, suitably ranging from 2 nm to 200 nm. Fibril cellulose is characterized by a large specific surface area and a strong ability to form hydrogen bonds. In water dispersion, fibril cellulose typically appears as either light or almost colorless gel-like material. Depending on the fiber raw material, fibril cellulose may also contain small amounts of other wood components, such as hemicellulose or lignin. Often used parallel names for fibril cellulose include nano-fibrillated cellulose (NFC), which is often simply called nanocellulose, and micro-fibrillated cellulose (MFC).

In general, current high aspect ratio cellulosic blends of cellulosic nano-filaments and micro-filaments may be obtained through a fibrillation process applied to raw cellulose fibers. Fibrillation of cellulose fibers may be accomplished through mechanical and/or chemical and/or biological means or a combination of the individual methods. Using mechanical shearing, the cellulose fibers are separated into a three dimensional network of nano-fibrils and/or micro-fibrils with a large surface area. Examples of mechanical shearing methods include, but are not limited to pulp beaters, refiners equipped with either refining discs (disc refiners) or a refining plug in a conical housing (conical refiner), ball mills, rod mills, kneader pulper, high or low pressure fluidized/homogenizer, microfluidizer, edger runner and drop work. Mechanical treatment may be accomplished via a continuous or a discontinuous process. According to a preferred embodiment of the first aspect of the present invention there is provided a method wherein the cellulose fibers (cellulose material) is present in the form of a pulp, which may be chemical pulp, mechanical pulp, thermomechanical pulp or chemi(thermo)mechanical pulp (CMP or CTMP). The chemical pulp is preferably a sulphite pulp or a Kraft pulp.

The pulp may consist of pulp from hardwood, softwood, non-wood pulps, agricultural waste pulps or any combination of the before mentioned types. The pulp may contain a mixture of cellulosic materials. Further, chemical pulps that may be used in the present disclosure include all types of chemical wood- and plant-based pulps, such as bleached, half-bleached and unbleached sulphite, Kraft and soda pulps, and mixtures of these. The may also comprise textile fibers. One of skill in the art will recognize that the consistency of the pulp during manufacture of cellulose nano-filaments and/or micro-filaments for the nano-filament and/or micro-filament blends herein may be any useful consistency, ranging from low consistency through medium consistency to high consistency.

The mechanical disintegration process used to create cellulose nano-filaments and micro-filament blends may be performed by any apparatus, known by a person skilled in the art including and not limited to the afore mentioned pulp beaters, refiners, ball mills, rod mills, kneader pulper fluidizer, homogenizer, edge runner and drop work.

Those skilled in the art also understand that a combination of chemical, biological, and mechanical operations can be utilized to create the cellulose nano-filaments and micro-filament blends and it may be preferred to pre-treat pulp chemically, prior to mechanical action to reduce energy requirements and to improve cellulose filament characteristics. Those skilled in the art also recognize that including biological treatments such as, but not limited to enzymatic treatment, can also be used to either pre or post treat mechanically or chemically treated cellulose material to create cellulose filaments used as a feed for the inventive process.

Cellulose filaments can be liberated from woody tissues as disclosed in exemplary U.S. Pat. No. 5,964,983 where micro-fibrillated and nano-fibrillated cellulose from the primary cell wall comprising a multistep process involving either acidic or basic hydrolysis at temperatures between 60° C. and 100° C. followed by high mechanical shear followed by high pressure homogenization. Following these steps, a decolorization process is required to create a white product and this is accomplished by bleaching the filaments.

An example of the state of the art methodology for liberating cellulose filaments from herbaceous materials chemically is represented by the technology described in International Patent Publication No. WO 2006/0566737. The method comprises the controlled fermentation of the more readily digestible parts of the primary plant cell walls by a consortium of microorganisms. This method was modified in U.S. Patent Publication No. 2017/0167079 A1 where it was discovered that largely intact cellulose microfibrils could be liberated via enzymatic treatments of biomass via digestion using polysaccharides hydrolases belonging to the families where cellulose belong in a non-exhaustive list comprising CAZy families: GH5, GH6, GH7, GH8, GH9, GH12, GH44, GH48. Largely intact fibrils were obtained by using one or more of these families in a chemical digestion of herbaceous plant materials.

Figure 2:
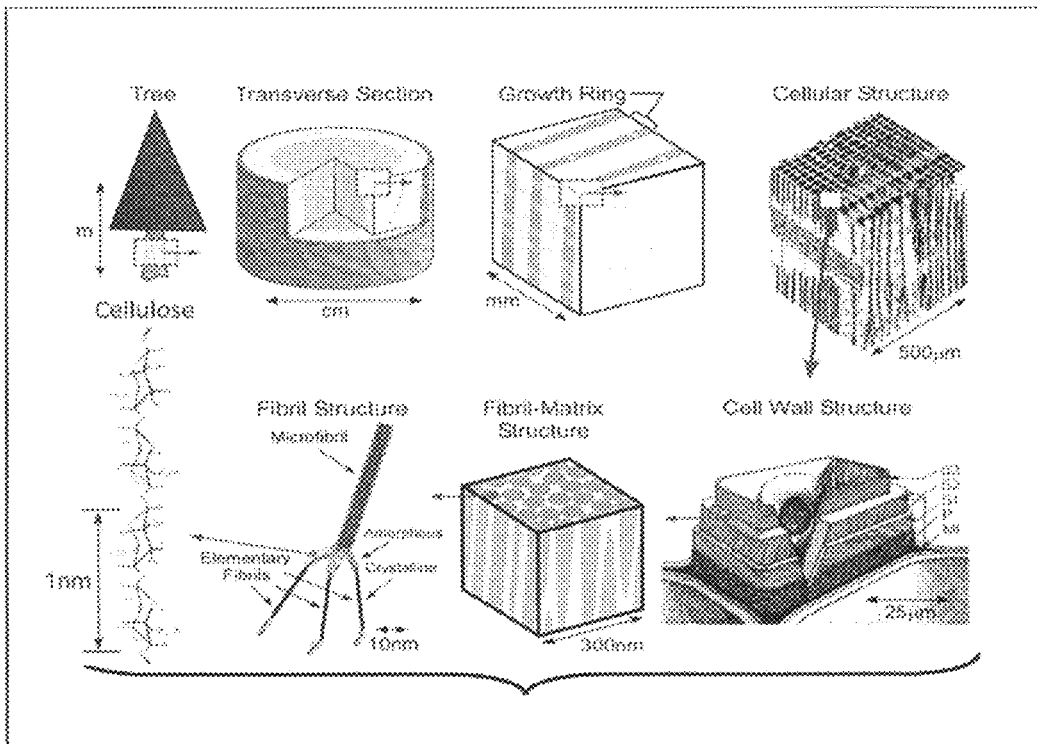
FIG. 2 is a illustration depicting the formation of cellulose nano- and micro-filaments.

As shown in FIG. 2, the obtained fibrils are much smaller in diameter compared to the original fibers and can form a network or a web-like structure.

The high aspect ratio cellulosic nano-filament and micro-filament blend material of the present disclosure may be made by any process known in the industry for making cellulosic nano-filament and micro-filament blends having a high aspect ratio. Fibrillation of cellulose fibers may be accomplished through mechanical and/or chemical and/or biological means or a combination of the individual methods. Non-limiting examples of the processes to produce high aspect ratio cellulosic nano-filament and micro-filament blends is disclosed by Hua, et al (U.S. Pat. No. 9,856,607 B2, U.S. Patent Application Publication 20150275433A1), Bjorkquist, et al. (U.S. Patent Application Publication 2015/0057442 A1), Isogai, et al (U.S. Pat. No. 8,992,728 B2) and Ankefors et al in (U.S. Patent Application Publication 2009/0221812A1. These materials are exemplified by their high aspect ratio, as compared to other cellulose micro-particles and nano-particles and cellulose fibers themselves.

In general, high aspect ratio cellulosic blends of cellulosic nano-filaments and micro-filaments may be obtained through a fibrillation process applied to raw cellulose fibers. Fibrillation of cellulose fibers may be accomplished through mechanical and/or chemical and/or biological means or a combination of the individual methods. Using mechanical shearing, the cellulose fibers are separated into a three dimensional network of nano-fibrils and/or micro-fibrils with a large surface area. Examples of mechanical shearing methods include, but are not limited to pulp beaters, refiners equipped with either refining discs (disc refiners) or a refining plug in a conical housing (conical refiner), ball mills, rod mills, kneader pulper, high or low pressure fluidized/homogenizer, microfluidizer, edger runner and drop work. Mechanical treatment may be accomplished via a continuous or a discontinuous process. According to a preferred embodiment of the first aspect of the present invention there is provided a method wherein the cellulose fibers (cellulose material) is present in the form of a pulp, which may be chemical pulp, mechanical pulp, thermomechanical pulp or chemi(thermo)mechanical pulp (CMP or CTMP). The chemical pulp is preferably a sulphite pulp or a Kraft pulp.

The pulp may consist of pulp from hardwood, softwood, non-wood pulps, agricultural waste pulps or any combination of the before mentioned types. The pulp may contain a mixture of cellulosic materials. Further, chemical pulps that may be used in the present disclosure include all types of chemical wood- and plant-based pulps, such as bleached, half-bleached and unbleached sulphite, Kraft and soda pulps, and mixtures of these. The may also comprise textile fibers. One of skill in the art will recognize that the consistency of the pulp during manufacture of cellulose nano-filaments and/or micro-filaments for the nano-filament and/or micro-filament blends herein may be any useful consistency, ranging from low consistency through medium consistency to high consistency.

The mechanical disintegration process used to create cellulose nano-filaments and micro-filament blends may be performed by any apparatus, known by a person skilled in the art including and not limited to the afore mentioned pulp beaters, refiners, ball mills, rod mills, kneader pulper fluidizer, homogenizer, edge runner and drop work. Those skilled in the art also understand that a combination of chemical, biological, and mechanical operations can be utilized to create the cellulose nano-filaments and micro-filament blends and it may be preferred to pre-treat pulp chemically, prior to mechanical action to reduce energy requirements and to improve cellulose filament characteristics. Those skilled in the art also recognize that including biological treatments such as, but not limited to enzymatic treatment, can also be used to either pre or post treat mechanically or chemically treated cellulose material to create cellulose filaments used as a feed for the inventive process.

Cellulose filaments can be liberated from woody tissues as disclosed in exemplary U.S. Pat. No. 5,964,983 where micro-fibrillated and nano-fibrillated cellulose from the primary cell wall comprising a multistep process involving either acidic or basic hydrolysis at temperatures between 60° C. and 100° C. followed by high mechanical shear followed by high pressure homogenization. Following these steps, a decolorization process is required to create a white product and this is accomplished by bleaching the filaments.

An example of the state of the art methodology for liberating microfibrils from herbaceous materials chemically is represented by the technology described in International Patent Publication No. WO 2006/0566737. The method comprises the controlled fermentation of the more readily digestible parts of the primary plant cell walls by a consortium of microorganisms. This method was modified in U.S. Patent Publication No. 2017/0167079 A1 where it was discovered that largely intact cellulose microfibrils could be liberated via enzymatic treatments of biomass via digestion using polysaccharides hydrolases belonging to the families where cellulose belong in a non-exhaustive list comprising CAZy families: GH5, GH6, GH7, GH8, GH9, GH12, GH44, GH48. Largely intact fibrils were obtained by using one or more of these families in a chemical digestion of herbaceous plant materials.

The obtained fibrils are much smaller in diameter compared to the original pulp fibers and can form a network or a web-like structure. Currently available high aspect ratio cellulosic nano-filaments and micro-filaments can have a length of at least about 25 μm up to about 2 millimeters. These materials are further characterized as having a width of less than about 20 μm (20,000 nm). These materials are further characterized as having a high length to width ratio (i.e. an "aspect ratio") of greater than about 50.

The currently available high aspect ratio cellulosic nano-filament and micro-filament blend material delivered to the process of the present disclosure may be made by any process known in the industry for making cellulosic nano-filament and micro-filament blends having a high aspect ratio. Fibrillation of cellulose fibers may be accomplished through mechanical and/or chemical and/or biological means or a combination of the individual methods. Non-limiting examples of the processes to produce high aspect ratio cellulosic nano-filament and micro-filament blends is disclosed by Hua, et al (U.S. Pat. No. 9,856,607 B2, U.S. Patent Application Publication 20150275433A1), Bjorkquist, et al. (U.S. Patent Application Publication 2015/0057442 A1), Isogai, et al (U.S. Pat. No. 8,992,728 B2) and Ankefors et al in (U.S. Patent Application Publication 2009/0221812A1. These materials are exemplified by their high aspect ratio, as compared to other cellulose micro-particles and nano-particles and cellulose fibers themselves.

Hua et al. (U.S. Pat. No. 9,856,607B2) disclosed that use of a fractionation step after nanofilamentation where the fractionation device separates the nanofilaments preferred by Hua from the remaining, and assumed to be unacceptable, pulp consisting of large filaments and fibers. the large filaments and fibers are recycled back to the pulp storage tank for reprocessing.

Processes of Improving Filament Blends

The present disclosure relates to processes for improving high aspect ratio cellulose filament blends comprising the steps of: providing a blend of cellulose nano-filaments or a blend of cellulose micro-filaments; diluting the blend of cellulose nano-filaments or blend of cellulose micro-filaments to a target consistency; fractionating the blend of cellulose nano-filaments or blend of cellulose micro-filaments; and, collecting the fraction of cellulose micro-filaments that have a length of greater than at least about 25 μm, preferably at least about 50 μm, and more preferably at least about 100 μm. In an alternative embodiment the collecting and removing step, removes the fraction of the diluted blend of cellulose nano-filament or the diluted blend of cellulose micro-filaments having an aspect ratio of less than about 50, preferably less than about 100, and more preferably less than about 200 μm.

The dilution and/or washing step is preferably done with water. In another exemplary embodiment, the water of the diluting and washing steps can have a pH of greater than 7, or a pH of greater than about 8, or a pH of greater than about 9, or a pH of greater than about 10. In yet another embodiment the water of the diluting and washing steps can initially have a pH reduced to a level less than about 6 and more preferably less than about 5, and then have the ph raised to a level greater than about 7, preferably greater than about 8, and even more preferably greater than about 9.

The fractionating step may be performed by any method of fractionating solids from liquids known to those of skill in the art. In one exemplary embodiment, the fractionating step may be performed by centrifuging the diluted sample and decanting the liquid phase from the centrifuged product.

In yet another exemplary embodiment, the steps of diluting and washing the blend of cellulose nano-filaments or blend of cellulose micro-filaments with water and fractionating the diluted blend of cellulose nano-filaments or blend of cellulose micro-filaments can be performed sequentially, or at least twice sequentially, or at least three times sequentially.

It was surprisingly found that the improved blends of cellulose nano-filaments or cellulose micro-filaments produced by the processes of the present disclosure provides paper products having superior dry strength Both the dilution and/or washing and/or fractionation process steps contemplated in this disclosure are a conventional system design and can be accomplished via multiple equipment configuration options. Without desiring to be bound by theory, it is believed that one of skill in the art will understand that a representative resulting target consistency of the diluted blend of cellulose nano-filaments or blend of cellulose micro-filaments can be less than 4%, or less that 2%, or less than 1%, or less than 0.5%, or less than 0.3.

Those skilled in the art could envision a fractionation process of the diluted blend of cellulose nano-filaments or blend of cellulose micro-filaments can use, but is not limited to hydrocyclones, centrifugation, perforated screen baskets, disk filters, displacement drum washers, sludge presses and other similar unit operations not discussed here but use gravitational or supported webs and the addition of alkaline water to both wash and fractionate the material. The process would be designed and operated such that there would be a targeted removal of material in the particle size smaller than that which passes a 325 mesh screen. Those skilled in the art would also recognize that these unit operations do not need to be exclusive and that a process stream could be developed that uses many stages of one technology and/or mix stages may be desirable to achieve the targeted results while operating within the constraints of a mill or mill environment. The pH of the wash stream is targeted in the alkaline region, for example greater than pH=7.0, or greater than pH=8.0, or greater than pH=9 pH, or greater than pH=10.0.

Improved Filament Blends

The present disclosure relates to an improved process for producing improved cellulosic filament and cellulosic micro-filament blends. The processes used to produce these blends have been found to have significantly reduced levels of filaments having a length of less than about 25 μm. With the reduction of shorter length filaments, the process disclosed produce blends that have significantly greater average aspect ratio, with the elimination of low aspect ratio filaments.

While it is not the intention to be bound by any particular theory regarding the present disclosure, it is believed that the performance attributes of the micro-filaments and/or nano-filaments is due to their relatively long length and their very fine (i.e., narrow) width. The narrow width of the micro-filaments and/or nano-filaments can enable a high flexibility and a greater bonding area per unit mass of the micro-filaments and/or nano-filaments, while with their long length, allows one micro-filament and/or nano-filament to bridge and intertwine with many fibers and other components together.

While the cellulosic micro-filaments and/or nano-filaments can represent a new class of fibrous material, it has been surprisingly found that cellulosic micro-filaments and/or nano-filaments could be further improved in both performance and operation by the addition of dilution, fractionation, and/or washing process stages to remove impurities and other fine nano-materials. This resulted in the surprising increase in the cellulose performance in the resulting paper sheet incorporating these cellulosic micro-filaments and/or nano-filaments.

In this disclosure, high aspect ratio cellulosic nano-filaments and micro-filaments are defined as cellulose fibrils and cellulose fibrillar bundles having an average length of at least about 25 μm, preferably from about 25 μm to about 2 mm, more preferably from about 25 μm to about 1 mm, and even more preferably from about 25 μm to about 500 μm.

These materials are further characterized as having a width of less than about 20 μm (20,000 nm), or less than about 1 μm (1,000 nm), or less than about 500 nm, or in the range of from about 30 nm to about 500 nm. These materials are further characterized as having a high length to width ratio (i.e. an "aspect ratio") of greater than about 50, or greater than about 100, or greater than about 200, or greater than about 1000. By high aspect ratio it is meant a filament length divided by fiber width of at least 50 to about 5000, preferably greater than about 200 to about 1000.

Improved Paper Products

The present disclosure also relates to paper products comprising greater than about 0.05 percent by weight of the of the paper product of cellulose nano-filament blends produced by the improved processes for making cellulose nano-filament blends disclosed herein, and in particular the improved cellulose nano-filament blends disclosed herein. The paper products comprise greater than about 0.05 percent by weight of the paper product of the selected cellulose nano-filament blend. Other embodiments of the paper products preferably may comprise from about 0.05 percent to about 20 percent by weight of the paper product of the cellulose nano-filament blend, and more preferably from about 0.1 percent to about 5 percent by weight of said first of said at least two layers. In other embodiments the cellulose nanoparticles comprise from about 50.0 percent to about 99.0 percent by weight of the paper product, preferably from about 80.0 percent to about 95.0 percent by weight of said first of said at least two layers.

The paper product may comprise a plurality of overlapping fibers comprising fiber selected from the group consisting of softwoods, non-woods, hardwoods, and combinations thereof.

As used herein, "Paper Product", or "Paper Web Substrates", refers to any formed or dry laid, fibrous structure products, traditionally, but not necessarily, comprising cellulose fibers. Embodiments of the paper web substrates may encompass, without being limited to tissue products such as sanitary tissue products, towel products such as absorbent towels, paper board grade, paper packaging grades, paper used for high pressure laminate construction, paper board, and paper used for printing and writing and packaging grades. Other embodiments of the paper web substrates contemplated in the present invention also include without limitation, embryonice dry laid webs as used in air laid making processes encompassing loosely bound "fluff" structures of desired fibers.

"Fibrous structure," as used herein, means a structure that comprises one or more fiber layers. In one example, a fibrous structure according to the present invention means an orderly arrangement of fibers within a structure in order to perform a function. Non-limiting examples of fibrous structures of the present invention may include composite materials (including reinforced plastics and reinforced cement).

Nonlimiting examples of processes for making fibrous web structures include known wet-laid papermaking processes and air-laid papermaking processes and through-air dried processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

The paper products of the present invention comprise at least one layer comprising the cellulose nano-filament blend. That layer of the present paper product comprises at least about 0.05 percent by weight of the layer of the nanoparticles. Preferably that layer comprises from about 0.05 percent to about 20 percent by weight of the layer. More preferably that layer comprises from about 0.1 percent to about 5 percent by weight of the layer of the nanoparticles, and more preferably that layer comprises from about 0.5 percent to about 2.5 percent by weight of the layer of the nanoparticles.

The present paper products are formed from a plurality of overlapping fibers and also comprise a plurality of the cellulose nanoparticles. The paper web substrate is formed from a plurality of overlapping fibers selected from the group consisting of softwoods, non-woods, non cellulosic fibers, hardwoods, and combinations thereof.

It was surprisingly found that the improved blends of cellulose nano-filaments or cellulose micro-filaments produced by the processes of the present disclosure provides paper products having superior dry strength Prior art, for example UPM, Stora Enso, and independent researchers have taught that the inclusion of the very small particles in blends of cellulose nano-filament or blends of cellulose micro-filament materials were the source of the resulting fine paper product strength due to their participation in bonding. Further, The VTT Technical Research Center of Finland in its work published by Hans-Peter Hentze in "Nanocellulose Science Toward Application", for PulpPaper 2010, on Jun. 2, 2019 in Helsinki, Finland demonstrated its believe that the very small particles of the typical particle size distribution performed a bonding function with a paper product fiber matrix. A visual representation of the Hentze bonding function of the very small particles is represented in FIG. 1.

The typical believe in the industry to date is that the very small particle of the blend distribution is important in increasing the paper structure integrity. Therefore, it was a surprising discovery that the tensile strength increases significantly in the paper product incorporating the improved cellulose nano-filament blend having the portion of the originally provided cellulose nano-filament blend or cellulose micro-filament blend containing fraction of the Bauer McNett p325 classified material removed. Further, it is advantageous that improved cellulose nano- and micro-filament blends provides paper products that provide superior benefits over previous paper resulting paper products containing currently available cellulose nano-filament blends and cellulose micro-filament blends.

EXAMPLES

The following examples are presented to describe the present disclosure and to carry out the method for improving the nano-filaments. These examples should be taken as illustrative and are not meant to limit the scope of the disclosure.

Example 1

Cellulose nano-filaments (CNF) were obtained. The CNF were made from bleached softwood Kraft pulp according to the process of making CNF disclosed in Hua et al. (U.S. Pat. No. 9,856,607B2 or U.S. Patent Application Publication 2015/0275433A1). The CNF blend was received as an aqueous suspension having a consistency of 31.4% solids. The provided CNF blend was diluted with stirring with water at 80° to a consistency of 1.2%. The pH of the 1.2% dilution of CNF was then lowered to a pH of 4.0 and stirred for two hours. The pH of that dilution was then raised to a pH of 11. Sufficient material was set aside for production of hand sheet as a control material.

The high pH dilution of the CNF blend was then centrifuged and the low-solids (liquid) fraction was decanted off the sample leaving the high-solids fraction for collection. The remaining solid from the first dilution/fractionation/collection cycle, containing fraction was again diluted to 1.2% at a pH of 11 and stirred, and was again centrifuged and the liquid fraction decanted off. The solid retaining sample was, for a third time treated with the pH11, 1.2% dilution/centrifuging/decanting cycle. The solid containing fraction is then treated with two complete dilution/centrifuging/decanting cycles but where the dilutions were at a neutral pH. This procedure yielded 95.5% by weight of the solids from the original sample.

Handsheets were made of a mixture of 90 bleached aspen pulp and 10% bleached softwood Kraft pulp and 1.5% of each of 1) the original control CNF blend and 2) fractionated/washed cellulose filaments blend. The data shows significant improvement for tensile strength compared to the not fractionated cellulose filament material.

| Handsheet Sample | Tensile Index |
|---|---|
| Control - 90% Aspen/10% NBSK/ 1.5% originally provided CNF control sample | 20.5 |
| 90% Aspen/10% NBSK/ 1.5% fractionated/washed CNF blend | 21.7 |

Test Methods

Scanning Electron Measurement of Cellulose Nano-Filament Dimensions

The length and width dimensions of cellulose nano-filaments can be measured by any technology for such measuring know in the industry. One example of such technology is described in an article by Peng, Yusheng; Gardner, Douglas; and Han, Yousoo in "Drying cellulose nanofibrils: in search of a suitable method"; Cellulose, published 2 Dec. 2011 (incorporated by reference herein). Peng discloses methods including preparation by oven drying, freeze drying, supercritical drying, and spray-drying followed by partical size and morphology measurement by dynamic light scattering, transmission electron microscopy, scanning electron microscopy, and morphological analysis.

A second example of technology to characterize cellulose nano-filaments is described in an article "Dynamic Characterization of Cellulose Nanofibris" by Zhe Yuan et al., 2018 IOP Conf Ser.: Mater. Sci. Eng 397 012002 (incorporated by reference herein). The technology disclosed includes that preparation of the sample by selective oxidation with TEMPO/NaBr/NaClO in an aqueous solution with dimensional characterization by electron-multiplying charge coupled imagery. The article teaches the characterization of fibril length and width (diameter) distributions for the fibril population.

To determine the aspect ratio of cellulose filaments the width and the length of a filament needs to be measured. As the resolution of microscopic images is not sufficient to measure the width (usually in the nm range) and the length (usually in the μm range) of a cellulose filament in one image other techniques needed to be employed. One option is to choose a microscopy method yielding the magnification and the resolution to measure the width of the filament. This can be achieved using for example scanning electron microscopy. Multiple images along the length of the filament with the identical magnification are taken and electronically stitched together resulting in one large image. The resulting image yields the possibility to measure the length of the filament to calculate the width to length aspect ratio.

Bauer McNett Particle Size Classification

Fiber length of pulp can be analyzed by classification. The TAPPI T 233 test method is designed to measure the weighted average fiber length of a pulp. If a fiber is 1 mm in length and weighs w mg, then for a given pulp, the weighted average length (L) is $\Sigma(wl)/\Sigma w$, or the sum of the products of the weight times the length of each fiber divided by the total weight of the fibers in the specimen.

A Bauer McNett type classifier can be used for TAPPI T 233 testing. The Bauer McNett fiber classifier consists of up to 5 narrow tanks 255 mm deep, 127 mm wide and 320 mm high, mounted in a cascade arrangement, with screens of 335 $cm^2$ mounted on the flat side. A vertical, cylindrical agitator with short paddles rotates at 580 rpm near one semi-circular end of each tank. This causes the suspension in each tank to flow horizontally across the screen and circulate around the tank. An overflow weir is provided at the outgoing side of each screen, and a short pipe leads to the next tank with a finer screen, at a slightly lower level, or from the last tank, to drain away. A flow regulator supplies water at the rate of 11.35 l/min to the first tank. The motion of the water keeps the fibers from settling and presents them repeatedly to the screen through which they will pass if their length is less than twice the screen opening. Those skilled in the art recognize that multiple screen configurations can be used for fiber evaluation. The specific screens that would be used for this evaluation are Bauer McNett ASTM 28/48/100/200/325 mesh.

After filling the tanks with water, the prepared pulp sample of 10 grams as dry diluted in 3.333 liter of water is added to the topmost tank within 18 seconds. The agitators and water inflow are started. After the test (e.g., 20 minutes according to TAPPI and 15 minutes according to SCAN) the water influx is stopped. The agitators continue running for another 2 minutes until water flow to the drain from the lowest unit stops. The tanks are then drained through filters with vacuum assist. During the drainage the inside of the tanks and the screens are washed to capture residuals of fibers by the filter. The filters containing the fiber fractions are removed from the filter holders, dried to constant weight at 105° C. and weighed for analysis.

Consistency

Consistency is measured herein according to TAPPI Test Method T 240 om-07, Consistency (Concentration) of Pulp Suspensions, Technical Association of the Pulp and Paper Industry, 2007.

Any dimensions and/or values disclosed herein are not to be understood as being strictly limited to the exact numerical values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A process for improving high aspect ratio cellulose filament blends comprising the steps of:

a) providing a blend of cellulose nano-filaments or blend of cellulose micro-filaments that pass through a type 200 mesh;

b) diluting said blend of cellulose nano-filaments or said blend of cellulose micro-filaments to a target consistency;

c) fractionating said diluted blend of cellulose nano-filaments or said diluted blend of cellulose micro-filaments into, at least, a fraction having an average length of at least about 25 μm; and, d) collecting said fraction having an average length of greater than at least about 25 μm.

2. The process for improving high aspect ratio filament blends of claim 1 wherein the diluting of said blend of cellulose nano-filaments or said blend of cellulose micro-filaments of step b is done with water.

3. The process for improving high aspect ratio filament blends of claim 1 wherein the diluting step of step b) dilutes the blend of cellulose nano-filaments or said blend of cellulose microfilaments to a target consistency of less than 4%.

4. The process for improving high aspect ratio filament blends of claim 1 wherein the diluting step of step b) dilutes the blend of cellulose nano-filaments or said blend of cellulose microfilaments to a target consistency of less than 2%.

5. The process for improving high aspect ratio filament blends of claim 1 wherein the fractionation step of step c)

comprises centrifuging said diluted blend of cellulose nano-filaments or said diluted blend of cellulose micro-filaments from said step b); and, the collecting step of step d) further comprises decanting a fraction having an average length of less than 25 μm and leaving said fraction having an average length of at least about 25 μm for collection.

6. The process for improving high aspect ratio filament blends of claim 2 wherein the water of the dilution step b) has a pH of greater than about 7.

7. The process for improving high aspect ratio filament blends of claim 6 wherein the water of the diluting step b) has a pH of greater than about 8.

8. The process for improving high aspect ratio filament blends of claim 7 wherein the water of the diluting step b) has a pH of greater than about 9.

9. The process for improving high aspect ratio filament blends of claim 1 wherein the diluting step b), the fractionating step c), and the collecting step d) are performed sequentially.

10. The process for improving high aspect ratio filament blends of claim 9 wherein the sequential steps b), c) and d) are repeated at least twice.

11. The process for improving high aspect ratio filament blends of claim 10 wherein the sequential steps b), c) and d) are repeated at least three times.

12. The process of claim 1 wherein the collecting step d) collects said high-solids fraction of said diluted blend of cellulose nano-filaments or said diluted blend of cellulose microfilaments having an average length of greater than at least about 50 μm.

13. The process of claim 1 wherein the collecting step d) collects said fraction of said diluted blend of cellulose nano-filaments or said diluted blend of cellulose micro-filaments having an average length of greater than at least about 100 μm.

14. The process of claim 1 wherein the collecting step d) collects said fraction of said diluted blend of cellulose nano-filaments or said diluted blend of cellulose micro-filaments having an average aspect ratio of greater than at least about 50.

15. The process of claim 1 wherein the collecting step d) collects said fraction of said diluted blend of cellulose nano-filaments or said diluted blend of cellulose micro-filaments having an average aspect ratio of greater than at least about 100.

16. The process of claim 1 wherein the collecting step d) collects said fraction of said diluted blend of cellulose nano-filaments or said diluted blend of cellulose micro-filaments having an average aspect ratio of greater than at least about 200.

17. The process of claim 2 wherein the water of the diluting step is initially reduced to a pH of less than about 6 and then raised to a pH of greater than about 9.

18. The process of claim 2 wherein the water of the diluting step is initially reduced to a pH of less than about 5 and then raised to a pH of greater than about 9.

* * * * *